US011107376B2

(12) United States Patent
Carmel

(10) Patent No.: US 11,107,376 B2
(45) Date of Patent: Aug. 31, 2021

(54) LOW DRAG OUTDOOR MEDIA FACADE DISPLAY

(71) Applicant: Sky-Sign Tech Ltd., Tel Aviv (IL)

(72) Inventor: Aviv Carmel, Hod Hasharon (IL)

( * ) Notice: Subject to any disclaimer, the term of this patent is extended or adjusted under 35 U.S.C. 154(b) by 0 days.

(21) Appl. No.: 16/060,862

(22) PCT Filed: Dec. 14, 2016

(86) PCT No.: PCT/IL2016/051334

§ 371 (c)(1),
(2) Date: Jun. 8, 2018

(87) PCT Pub. No.: WO2017/103925

PCT Pub. Date: Jun. 22, 2017

(65) Prior Publication Data

US 2019/0005860 A1 Jan. 3, 2019

(30) Foreign Application Priority Data

Dec. 14, 2015 (IL) ..... 243064

(51) Int. Cl.
*G09F 7/22* (2006.01)
*G09F 15/00* (2006.01)
*G09F 7/00* (2006.01)

(52) U.S. Cl.
CPC ..... *G09F 15/0087* (2013.01); *G09F 7/002* (2013.01); *G09F 7/22* (2013.01)

(58) Field of Classification Search
CPC ..... G09F 15/0087; G09F 7/22; G09F 7/002; G09F 15/0006; G09F 15/0012; G09F 15/0018
USPC ..... 40/602
See application file for complete search history.

(56) References Cited

U.S. PATENT DOCUMENTS

2009/0128461 A1* 5/2009 Geldard ..... G06F 3/1446 345/84
2010/0018098 A1* 1/2010 Xu ..... G05B 19/042 40/624
2014/0196334 A1* 7/2014 Gibson ..... G09F 7/22 40/606.15
2016/0247424 A1* 8/2016 Salazar Rodriguez ..... G09F 15/0025

FOREIGN PATENT DOCUMENTS

EP 2037438 A1 * 3/2009 ..... G09F 9/33

* cited by examiner

*Primary Examiner* — Cassandra Davis
(74) *Attorney, Agent, or Firm* — Benjamin Aaron Adler

(57) ABSTRACT

A low drag outdoor media façade display for mounting on a structure susceptible to instability when exposed to strong winds, having an array of radiating elements thinly dispersed about the façade area, held by an array of thin suspension elements, the elements are spaced apart leaving gaps, such that the total surface area of the elements is smaller than the total area of the façade display. A tilting mechanism, active or passive, is operational for tilting the façade display or at least one element thereof. The passive mechanism allows free tilt in response to wind blow, and the elements may include tails. The active mechanism is operational for altering wind load drag profile of the façade display to accommodate wind conditions. The display may be inflatable or collapsible sail-like. A display featuring a liquid spray curtain for refracting or reflecting light projections is a further measure for reducing wind load.

20 Claims, 10 Drawing Sheets

LOW DRAG OUTDOOR MEDIA FACADE DISPLAY

FIELD OF THE INVENTION

The present invention relates generally to media façade displays, signs, and billboards, and specifically to billboards disposed on constructions susceptible to instability in windy conditions, such as tower cranes.

BACKGROUND OF THE INVENTION

High rise structures provide a convenient foothold for placing media façades and billboards, due to the exposure of high location to large target crowds, especially if the location is in the vicinity of pedestrians or of vehicle traffic. This is particularly true when the structures are temporarily erected and do not require permanent regulation and avoid concealment of view from inhabited buildings. Tower cranes and other high rise lightweight lattice structures can provide a platform for such a foothold. Tower cranes, which are a prevalent example of such structures, generally consist of the same basic parts: the base, the tower or mast, and the slewing unit. The base supports the crane, the mast which connects the base to the slewing unit and gives the crane its height, and the slewing unit is attached to the top of the mast, and includes the gear and motor that allow the crane to rotate. The slewing unit includes three parts: the long horizontal jib or working arm, the shorter horizontal machinery arm, and the operator's cab. The long horizontal jib carries the load, the shorter horizontal machinery arm contains the crane's motor that lifts the load, control electronics that drive the motor, large concrete counter weights, and the cable drum, and the operator's cab. The accumulation of body parts arranged at the shorter horizontal machinery arm, and their isolation from the moving parts of the working arm and from the operator's cab which need to be exposed, renders the machinery arm a convenient platform for placing an outdoor media façade display, such as a billboard. However, media façades and billboards installed on tower cranes and other high rise structures thereon must not frustrate the winds and gusts durability that is required by such high-rise structures, despite their extremely large drag due to their expanded surface area that is comparable to and emulates a sail at such a height.

SUMMARY OF THE INVENTION

In accordance with one aspect of the present invention, there is thus provided a low drag outdoor media façade display for mounting on a structure susceptible to instability and tumbledown when the structure is exposed to strong winds and gusts blowing on the façade. The façade display includes an array of radiating elements thinly dispersed about the façade area, the radiating elements are held by an array of thin suspension elements, wherein the radiating elements and the suspension elements are spaced apart leaving gaps, such that the total surface area of the radiating elements and the suspension elements is smaller than the total area of the façade display. The façade display further comprises at least one tilting mechanism, either active of passive, which is operational for tilting the façade display or at least one element thereof, including the radiating suspension elements, the suspension elements, an optional frame of the façade display for supporting the suspension elements, and optional sub-frames of the frame.

In accordance with the passive tilt, at least one of: the façade display, a frame supporting the suspension elements, sub-frames of the frame, the array of suspension elements, and the array of radiating elements, is passively tiltable and tilts freely in response to wind blowing on the façade surface area.

In accordance with the active tilt, the façade display further includes an active tilting mechanism for selectively tilting, in correlation with wind conditions, at least one of: the façade display, a frame supporting the suspension elements; sub-frames of the frame; the suspension elements; and the radiating elements, wherein the tilting is operational for altering wind load drag profile of the façade display to accommodate the wind conditions. The display can be a hoarding, a bulletin, a poster, a marquee, a banner, a placard, a billing board, a billboard, a mobile billboard, a digital billboard, a mechanical billboard, a three-dimensional billboard, a street sign or a traffic control signal. The structure can be a high rise lightweight structure; a lattice mast; a tower; an arm; a boom; a machine arm of a tower crane; a crane; a hammerhead crane; a tower crane; a gantry; a derrick; scaffoldings; a fence; permanent or temporary structure; a lattice structure; a mobile structure; a pillar; a mast; a land vehicle, a marine vehicle, or an aerial vehicle hauling a towed banner. The display façade can include an array of fixed light radiating elements fixedly arranged about the façade area. The arrangement of the suspension strips on the display façade may be horizontally, vertically or mesh. The radiating elements may be reflecting elements, refracting elements, emitting elements, optical reflectors, mirrors, optical refractors, lenses, liquid lenses, light emitting sources, or led elements. The fixed light radiating elements may be held onto a support frame enclosing the façade display at its peripheral rim, by thin suspension strips.

The radiating elements may feature tails pointing up or down, in a curved, triangular, tapered, or trapezoidal shape. The radiating elements freely rotate in response to wind blowing over the tails.

The frame may be mounted at an angled position, and can feature a tilting mechanism for selectively tilting the frame. The frame may be divided by sub-frames, horizontal or vertical, such that each sub-frame is tilted separately. The tilting mechanism can selectively tilt the frame, or the sub-frames, the suspension elements or the radiating elements into a horizontal position an upright position, a collapsible configuration, or a position configured to minimize drag.

The display may be mounted on an arm of a tower crane which is allowed to spontaneously rotate in the wind. An optional maneuvering diverter may be provided for enhancing exposure to targeted audience, by diverting the display in a horizontal-vertical tilt and/or in the desired sideways angle tilt, by tilting the frame, sub-frames of the frame, each suspension element on which the radiating elements are mounted to the frame, or each radiating element.

In accordance with another aspect of the present invention, there is provided a low drag outdoor media façade display for mounting on a structure susceptible to instability and tumbledown of the structure when effected by strong winds and gusts blowing on the façade surface area, wherein the façade display includes an inflatable display screen, or a collapsible sail-like screen. The media façade display may feature a spherical display surface, or an ellipsoid, wherein the display partially or fully enshrouds a portion of the structure.

In accordance with a further aspect of the present invention, there is provided a low drag outdoor media façade display for mounting on a structure susceptible to instability and tumbledown of the structure when effected by strong winds and gusts blowing on the façade surface area, wherein the façade display includes a liquid spray curtain created by thinly sprayed transient radiating liquid elements that refract/reflect laser/light projections. The liquid spray curtain may feature sprayed droplets, hydro shield projections, a water screen, or a fog screen, wherein the liquid is sprayed with jet nozzles, downwards or upwards. The liquid spray may include a water spray which is vaporized and is shaped by two air shields. The liquid spray curtain may be vertical, upright with liquid falling by the gravitational force, include an angled/tilted or ballistic surface when sprayed at a direction having a horizontal component, or include an angled/tilted or ballistic surface when shaped with the force of frontal and/or rear air shield(s). The liquid may be collected for reuse by means of a narrow trough extending along the bottom rim of the facade display.

According to a further aspect of the invention, there is provided a flock of outdoor media façade displays respectively mounted on a multiplicity of crowded structures, wherein the flock of façade displays is synchronized to maneuver to directions suitable for reaching an audience and for creating a mega-display presentation combined by the scenery resulting by all of the participating façade displays. The mega-display presentation may be created in conjunction with passing by object(s).

BRIEF DESCRIPTION OF THE DRAWINGS

The present invention will be understood and appreciated more fully from the following detailed description taken in conjunction with the drawings in which.

DETAILED DESCRIPTION OF THE EMBODIMENTS

Figure 1:
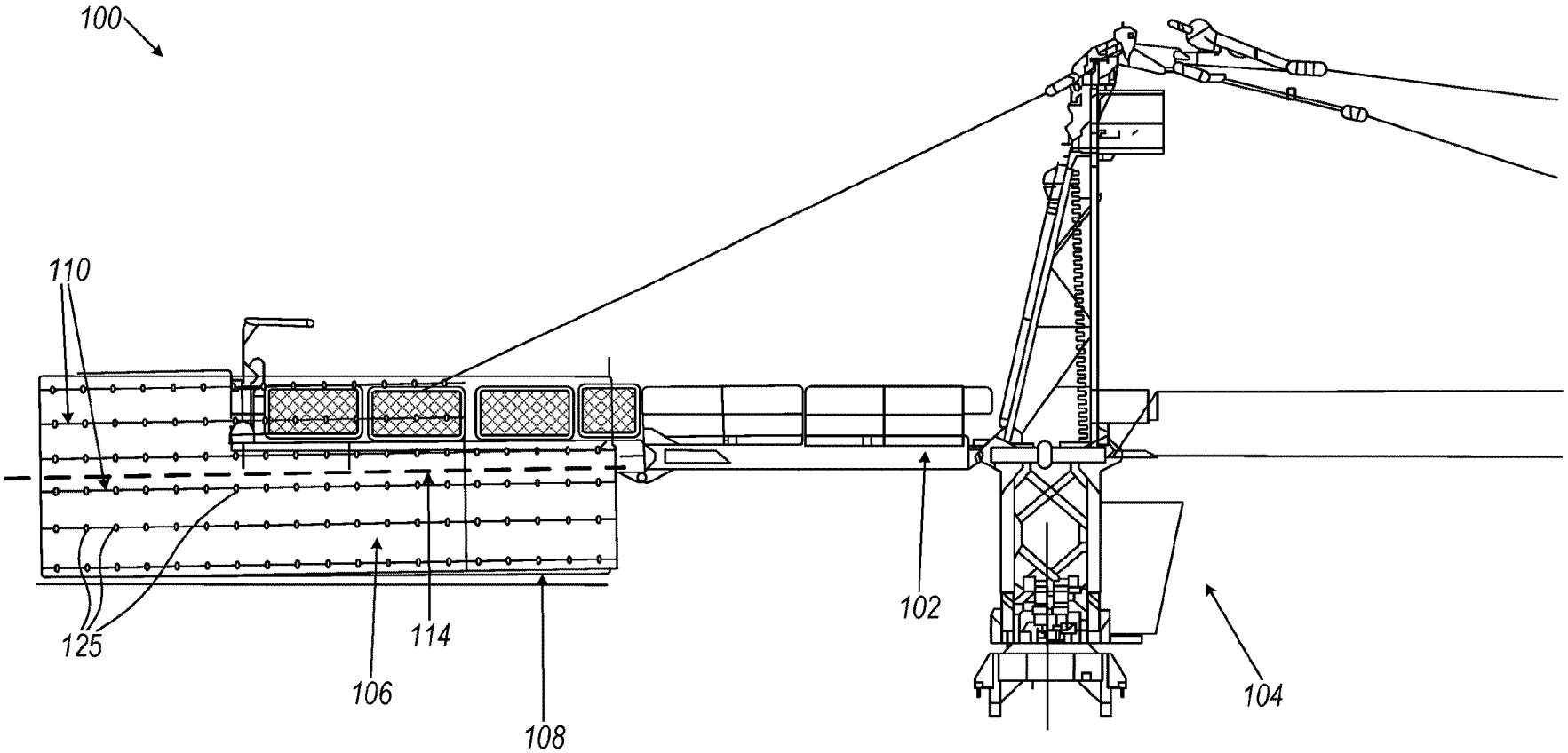
FIG. 1 is a schematic illustration of a low drag outdoor media façade display constructed and operative in accordance with an embodiment of the invention, mounted on the working arm of a tower crane.

The present invention overcomes the disadvantages of the prior art by providing an outdoor media façade display, such as a billboard, for mounting on lightweight structures, mostly lattice masts, towers, arms or booms, such as the machine arm of a tower crane. The media façade display features a sparse array of radiating elements dispersed about the façade area which reduces instability and tumbledown of the structure when exposed to strong winds and gusts.

The façade display can be used for a variety of outdoor displays, including a hoarding, a bulletin, a poster, a marquee, a banner (including hauled by a towing aircraft), a placard, a billing board, a billboard, a mobile billboard, a digital billboard, a mechanical billboard, a three-dimensional billboard, a street sign, and a traffic control signal.

The high-rise structure may include a crane (hammerhead, tower and any other type), a gantry, a derrick, scaffoldings, fences, and other permanent or temporary structures, typically lattice structures designed to be lightweight and strong enough to support lifted loads, and/or provide rapid assembly and disassembly on site—and sometimes are even mobile. Such structures are less stable than buildings, bridges, and permanent constructions and structures than can withstand strong winds, and thus are subject to instability, unsettling and even total tumble down when exposed to high winds and gusts. In some cases, the holding structure can be a land vehicle (such as a box truck), a marine vehicle, and an aerial vehicle hauling a towed banner.

The presence of such structures in urban, densely populated areas, are in proximity to heavily trafficked roads and highways, render such structures as preferred pillars or masts for supporting or installing of billboards and other large scale outdoor display boards. However, the large surface area of such display boards encumbers a sail-like effect on the structure upon which it is mounted when high winds and gusts blow on the display board.

In accordance with the invention, the novel façade display disclosed herein, features an array of fixed light radiating elements thinly dispersed about the façade area, or alternatively—transient radiating liquid elements, i.e., sprayed droplets. Further variations include an inflatable display and a collapsible sail-like display, and a towed banner hauled by an aerial vehicle. Due to its inherent low drag profile, the façade display is readily suitable also as a vehicle-towed banner, which is particularly useful for aerial crafts hauling a towed banner. The term 'radiating' refers to reflecting, refracting, or emitting elements, including optical reflectors such as mirrors, optical refractors such as lenses, solid or liquid, and all light emitting sources such as led elements.

According to one aspect of the invention, the façade display or elements thereof may be tiltable, by one or two distinct types of tilting: either selectively tiltable—by an active suitable tilt-driving mechanism, or passively, freely tiltable for allowing passive tilting in response to, and optionally in correlation with the intensity of, wind blowing on the façade display. The selective tilt may be used for controlling the reduction drag of the façade display according to the general wind conditions (e.g., directing for reducing drag into a locked positioning, up to a complete folding of the element), or for directing the façade or its radiating elements toward a desired display presentation direction.

If no free tilt is implemented, the active tilting mechanism is primarily used for selectively tilting, in correlation with wind conditions, at least one of a frame supporting the suspension elements, sub-frames of the frame, the suspension elements, and the radiating elements, wherein the active tilting is operational for altering wind load drag profile of the façade display to accommodate wind conditions.

Free tilt spontaneously reduces drag of the façade display, by allowing loose movement without a forced drive or a lock. The selective tilting mechanism may be used to tilt elements of the façade display which differ from those that free tilt. For example, free tilt may be featured for the loose movement of the entire façade display, a frame of the display, sub-frames of the frame, an array of radiating elements of the display, or of suspension elements holding the radiating elements onto the display, while the selective tilt may be featured for another element of the above mentioned (the entire façade display is to be interpreted as an "element" in this context). As the two types of tilt may interfere with each other at the same time, preferably each element may be either selectively, or freely, tiltable, whereas the same element is preferably not operational for both types of tilting at once, but may be tiltable by different tilt types, at different times.

Reference is now made to FIG. 1, which is a schematic illustration of a low drag outdoor media façade display, generally referenced 100, constructed and operative in accordance with an embodiment of the invention, mounted on a working arm, generally referenced 102, of a crane. Outdoor media façade display 100 is designed for mounting on a structure which may be susceptible to instability and tumbledown when subjected to winds and gusts blowing on the façade surface area. Façade display 100 is mounted on the working arm 102 of tower crane 104. When tower crane 104 is not in use for construction works, tower crane 104 may be often left loose with regard to its rotational movement, allowing for spontaneous rotation as directed by the wind, such as with a weathervane, thereby featuring minimal drag without any directional manipulation. In such configuration, façade display 100 rotates together with loose arm 102.

Figure 12:
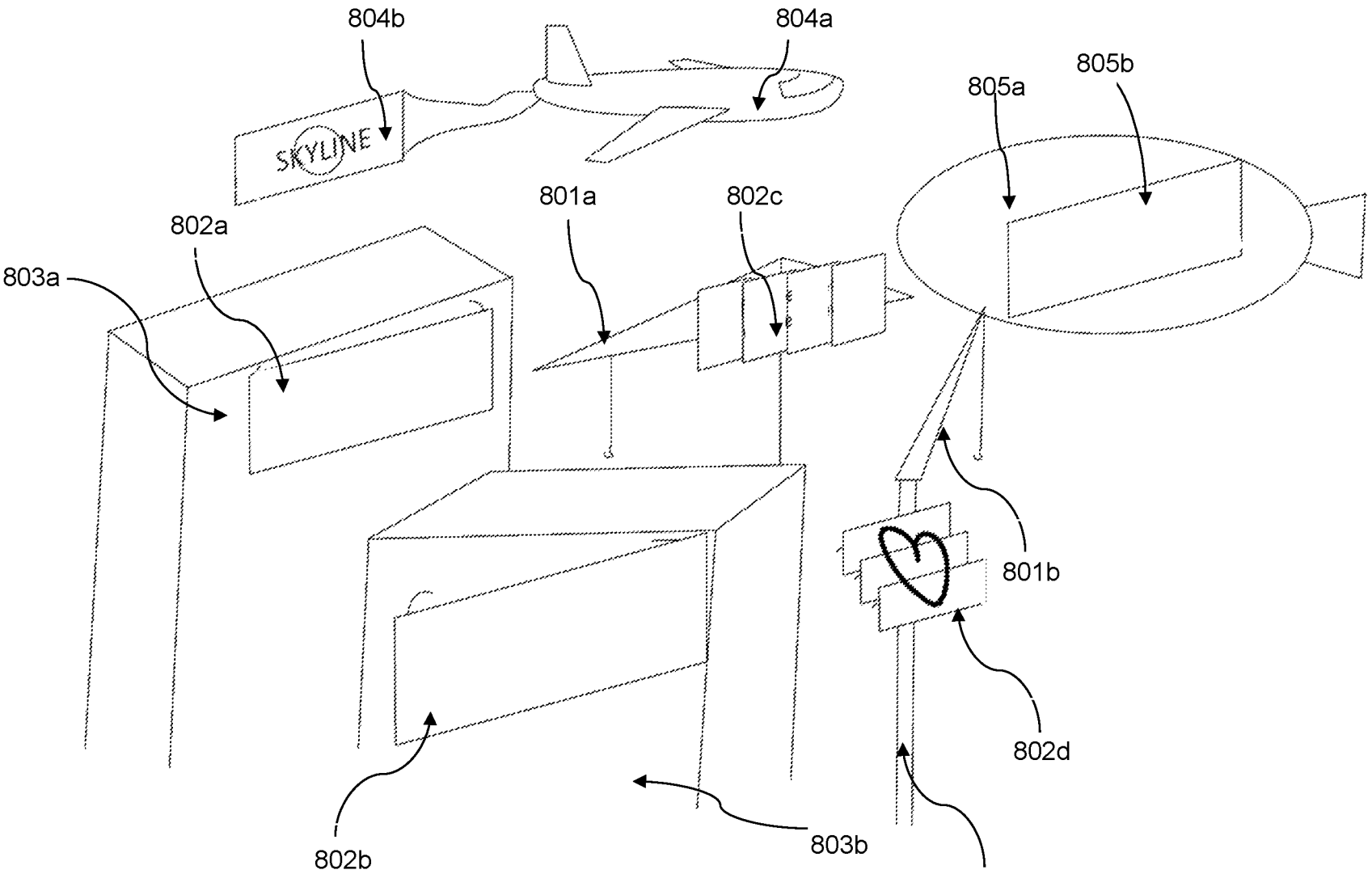
FIG. 12 is a schematic front view illustration of a flock of façade displays synchronized to maneuver to directions suitable for creating a mega-display and for reaching a crowd.

Reference is now also made to FIG. 12, which is a schematic front view illustration of a flock of façade displays synchronized to maneuver to directions suitable for creating a mega-display and for reaching a crowd. When a multiplicity of cranes 801*a,b* and other structures are crowded (including conventional displays 802*a,b,c,d* mounted on buildings 803*a,b* or pillars 803*c*), the flock or 'herd' of façade displays may be synchronized to maneuver to directions suitable for reaching the crowd or for creating a mega-display presentation—combined by the scenery resulting by all of the participating façade displays, as well as in conjunction with passing by objects such as a plane/zeppelin 804*a,b*, 805*a,b*, or land or marine vehicle, including those that carry or haul façade displays, wherein each display of the flock, is respectively mounted on a distinct structure of the multiplicity of spaced apart structures crowded in an area viewable by an audience.

Facade display 100 can be of any shape, such as rectangular, circular, or triangular. Façade display 100 includes an optional support frame 108 and an array of radiating elements 125. Support frame 108 encloses façade display 100 at its peripheral border. Radiating elements 125 are designed to emit light and may include light emitting diodes (LEDs). Radiating elements 125 are spaced apart from each other. The array of radiating elements 125 may be connected with an array of suspension elements 110, e.g., radiating elements 125 may be held by suspension elements 100, onto façade display 100. Suspension elements 110 may feature ligaments, strips, wires, yarns, rods, nets, mesh—including a mesh or a gauze projection screen. Suspension elements 110 form an intersecting lattice or a suspension array. The array of suspension elements 110 may be supported by support frame 108 as in FIG. 1, but in alternative embodiments the array of suspension elements 110 may not require any frame to be supported by, as the array may be constructed with suspensions elements, e.g., a matrix of rows and columns, that form a stable structure that adequately truss a façade display panel without support frame 108. Radiating elements 125 may be directly mounted to the array of suspension elements 110. Alternatively, radiating elements 125 may be indirectly mounted to suspension elements 110 with an additional mounting unit (not shown). Suspension elements 110 are deployed in a horizontally arranged suspension array on façade 100, but suspension elements 110 can also be deployed in other arrangements on the façade as well.

Radiating elements 125 and suspension elements 110 are arranged, such that the total surface area of radiating elements 125, suspension elements 110, and frame 108 (if frame 108 is required) is smaller than the total area of façade display 100. For example, frame 108 can be formed of narrow rods, suspension elements 110 can be formed of cables, strips, or wires, and radiating elements 125 can feature tiny LED elements. When suspension elements 110 and radiating elements 125 are sparsely distributed, leaving gaps in between, their total surface area would typically capture a small fraction of the total surface area 106 of façade display 100 (which is the same as of the virtual area surrounded by frame 108).

Figure 3:
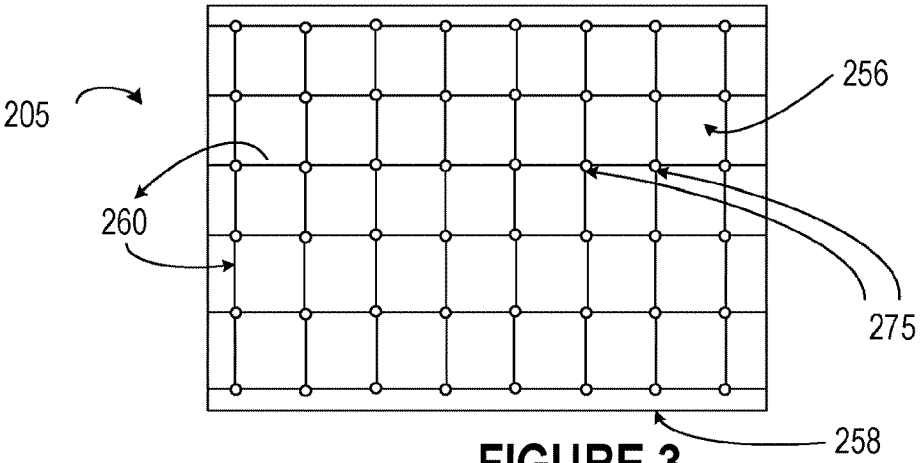
FIG. 3 is a schematic front view illustration of low drag outdoor media façade display, constructed and operative in accordance with a further embodiment of the invention.
Figure 2:
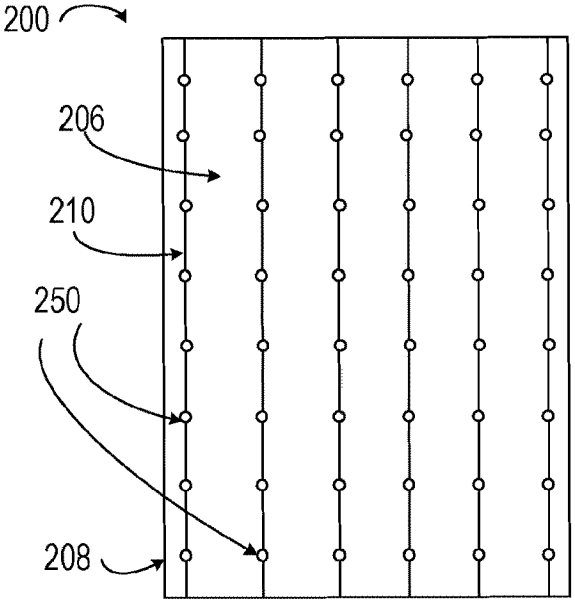
FIG. 2 is a schematic front view illustration of a low drag outdoor media façade display, constructed and operative in accordance with another embodiment of the invention.

Reference is now made to FIGS. 2 and 3. FIG. 2 is a schematic front view illustration of low drag outdoor media façade display, generally referenced 200, constructed and operative in accordance with another embodiment of the invention. FIG. 3 is a schematic front view illustration of low drag outdoor media façade display, generally referenced 205, constructed and operative in accordance with a further embodiment of the invention. Both façade 200 and façade 205 are similar to façade 100 of FIG. 1 but with alternative arrangements of suspension elements—suspension strips 210 of FIG. 2 and suspension strips 260 of FIG. 3. Suspension strips 210 form a vertically aligned suspension array. Suspension strips 260 form a deployed mesh suspension arrangement.

Figure 4:
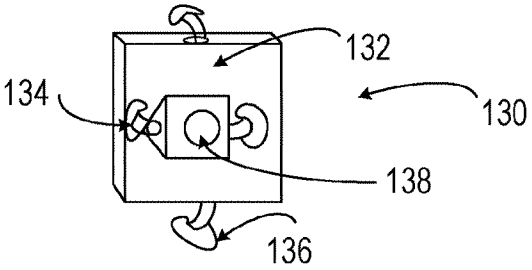
FIG. 4 is a is a zoomed in view illustration of a maneuverable radiating element of low drag outdoor media façade display, constructed and operative in accordance with yet another embodiment of the invention.

Reference is now made to FIG. 4, which is a zoomed in illustration of a maneuverable radiating element 130, constructed and operative in accordance with yet another embodiment of the invention. Element 130 includes mount 132 and operative radiating light element 138 secured onto mount 132. Radiating light element 138 is similar to radiating elements 125 of FIG. 1. Element 130 includes vertical hinges 136 which rotatably secure mount 132 to vertical suspension strips 210 (FIG. 2), and allow rotating mount 132 sidewise with an adequate rotation activator (not shown). Element 130 further includes horizontal hinges 134 which rotatably secure light element 138 to mount 132, and allow rotating light element 138 for elevation and drooping of its orientation with an adequate rotation activator (not shown). Vertical hinges 134 and horizontal hinges 136 may be substituted with horizontal hinges and vertical hinges, respectively, for being suspended between other elements (e.g., suspension strips 110 of FIG. 1). When all radiating elements 130 are synchronously maneuvered to be oriented towards a specific direction, the façade display would effectively radiate its image toward in the desired direction of an audience or a crowd.

The embodiment of FIG. 4 exemplifies a selective tilting mechanism, with a controlled tilt-activation or tilt-drive that allows selective orienting or titling of radiating elements 130, for actively directing the façade or its radiating elements toward a desired display presentation direction, which may be also useful for controlling the reduction drag of the façade display according to the general wind conditions, when radiating elements are aerodynamically shaped, as further exemplified below. If no passive tilting is implemented, the active tilting mechanism is primarily used for selectively tilting, in correlation with wind conditions, the entire display or an element thereof, wherein the tilting is operational for altering wind load drag profile of the façade display, to accommodate wind conditions, e.g., by changing aerodynamical profile or by changing the drag coefficient by altering the overall cross-section area facing the wind.

Figure 5A:
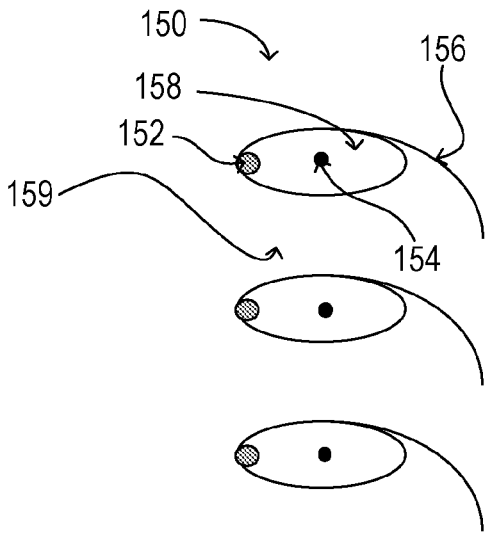
FIG. 5A is a cross sectional side view of ellipsoidal light elements with tails which form part of an array of light elements, constructed and operative in accordance with an embodiment of the invention.
Figure 5B:
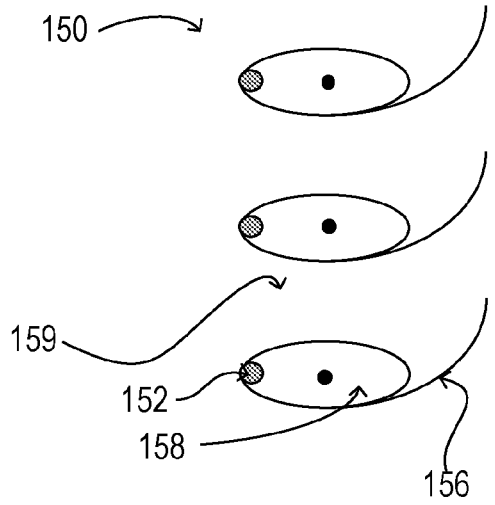
FIG. 5B is a cross sectional side view of circular radiating elements similar to those of FIG. 5A, with tails in an upward orientation.
Figure 5C:
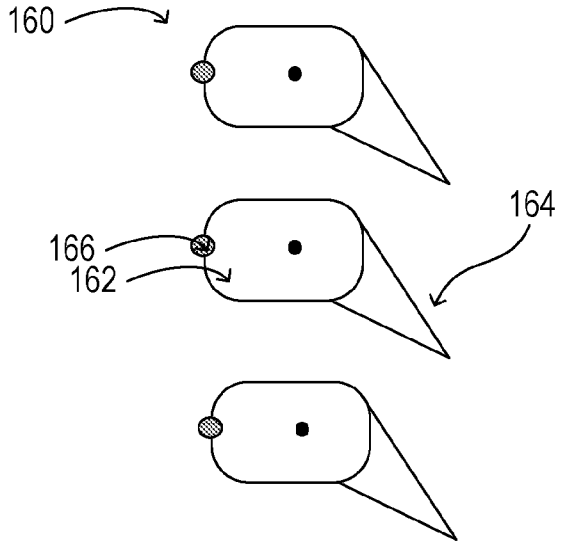
FIG. 5C is a cross sectional side view of rectangular radiating elements with straight tails, which form part of an array of light elements, constructed and operative in accordance with another embodiment of the invention.

Reference is now made to FIGS. 5A, 5B, and 5C. FIG. 5A is a cross sectional side view of ellipsoidal light elements with tails, generally referenced 150, which form part of an array of light elements, constructed and operative in accordance with an embodiment of the invention. FIG. 5B is a cross sectional side view of circular radiating elements similar to those of FIG. 5A, with tails in an upward orientation. FIG. 5C is a cross sectional side view of rectangular radiating elements with straight tails, which form part of an array of light elements, constructed and operative in accordance with another embodiment of the invention.

Ellipsoidal light element 150 includes an ellipsoidal mounting pod 158, a suspension strip attachment port 154, a tail 156, and a light radiating emitter, such as light radiating emitter radiating element 152. Ellipsoidal mounting pod 158 is aerodynamically shaped, by virtue of having an inherently low drag coefficient due to its ellipsoidal or elliptical shape when frontal wind blows on the array, i.e., from the left to the right of FIG. 5A.

Light elements 150 may be discrete bodies, each incorporating a single light emitting pixel (e.g., LEDs), which are evenly distributed along one elongated suspension element or strip, with vertical and horizontal ellipsoidal cross section profile. Light elements 150 may be elongate bodies, each spanning along an elongated suspension element or strip, with each light element 150 incorporating several pixels, which are evenly spaced and aligned in one elongated light element 150, wherein only the vertical cross-section profile is ellipsoidal.

Other shapes may be implemented, such as with circular cross section. Light emitter 152 is an element that produces radiant light, similar to radiating element 125 (FIG. 1) or 138 (FIG. 4). Suspension strip attachment port 154 accommodates a suspension strip, such as suspension element 110 of FIG. 1, and allows ellipsoidal mounting pod 158 to tilt or rotate about the suspension element strip (free rotation, which may be limited in span). The ellipsoidal cross section including its tail 156 will generally tend to rest in a particular positioning in still air, e.g., horizontally as in FIG. 5A. When frontal wind blows through the array of pods 158, tail 156 of each pod 158 is pushed backward by the wind and cause ellipsoidal pod 158 to rotate counter clockwise (up to a desired limit of rotation span) and thereby increase the free air passage through the array and reduce the drag coefficient of the entire array. When the wind is below a threshold that effects rotation of elements 150, tails 156 block passage of dazzling rear light (i.e., incoming from the left of FIG. 5A), such as of sunlight, that dazzles and reduces the image visibility created by elements 150 as seen by a target spectator (i.e., from a point of view to the left and downwards of the array of elements 158 in FIG. 5A). Attaching a multitude of mounting pods 158 to a suspension array forms an array of mounting pods 158 with light emitters 152. An array of mounting pods 158 with openings 159 allows wind to pass between mounting pods 158 without unsettling the support structure. Tails 156 prevent sunlight and other elements behind the façade from interfering with the viewing of the façade from a primary, frontal, viewing angle. Ellipsoidal mounting pods 158 are rotatable around suspension strip ports 154 such as to conceal the sunlight such (or adjustably controlled by adequate activators to rotate and provide adjusted shade) as the sun moves across the sky throughout the day. An array of ellipsoidal elements 150 may be drooping in a downwards orientation (FIG. 5A, tails pointing downwards) or looking up in an upwards orientation (FIG. 5B, tails pointing upwards) depending on the requirements of the array—e.g., FIG. 5B provides shading from a light source disposed below or at the back of the array). Alternatively, radiating elements such as radiating elements 166 of FIG. 5C, may be attached to an array of rectangular elements 160 with short, straight tails 164. Array 160 and its components are similar in function and configuration to the ellipsoidal light elements with tails 150 of FIG. 5A.

When wind blows through the array, elements 150 are uniformly rotated, and effect of rear light blocking is diminished in correlation to the degree of their rotation, and if light emitters 152 emit narrow light beams, the orientation of the façade display may be altered with the general tilting of light elements 150. Light emitters 152 may feature wider beam viewing angle, rather than a concentrate light output to a particular direction, to reduce diminishing of the display brightness of an audience in a desired direction. A modest compromise of best display orientation for front light emission and rear light block is a trade-off price well worth paying under strong winds that may jeopardize the very stability of the structure onto which the display façade is mounted. The embodiments of FIGS. 5A, 5B, 5C exemplify a passive, free tilt mechanism, distinct in operation and resulting with a different function in comparison with the selective ACTIVE tilting mechanism of FIG. 4. FIGS. 5A, 5B, 5C demonstrate freely tiltable or rotatable radiating elements, that tilt freely in response to wind blowing on the façade surface area, and thus are configured to reduce the drag of the façade display. Tilting typically occurs above a threshold and is typically correlated with the intensity of the wind.

Figure 6:
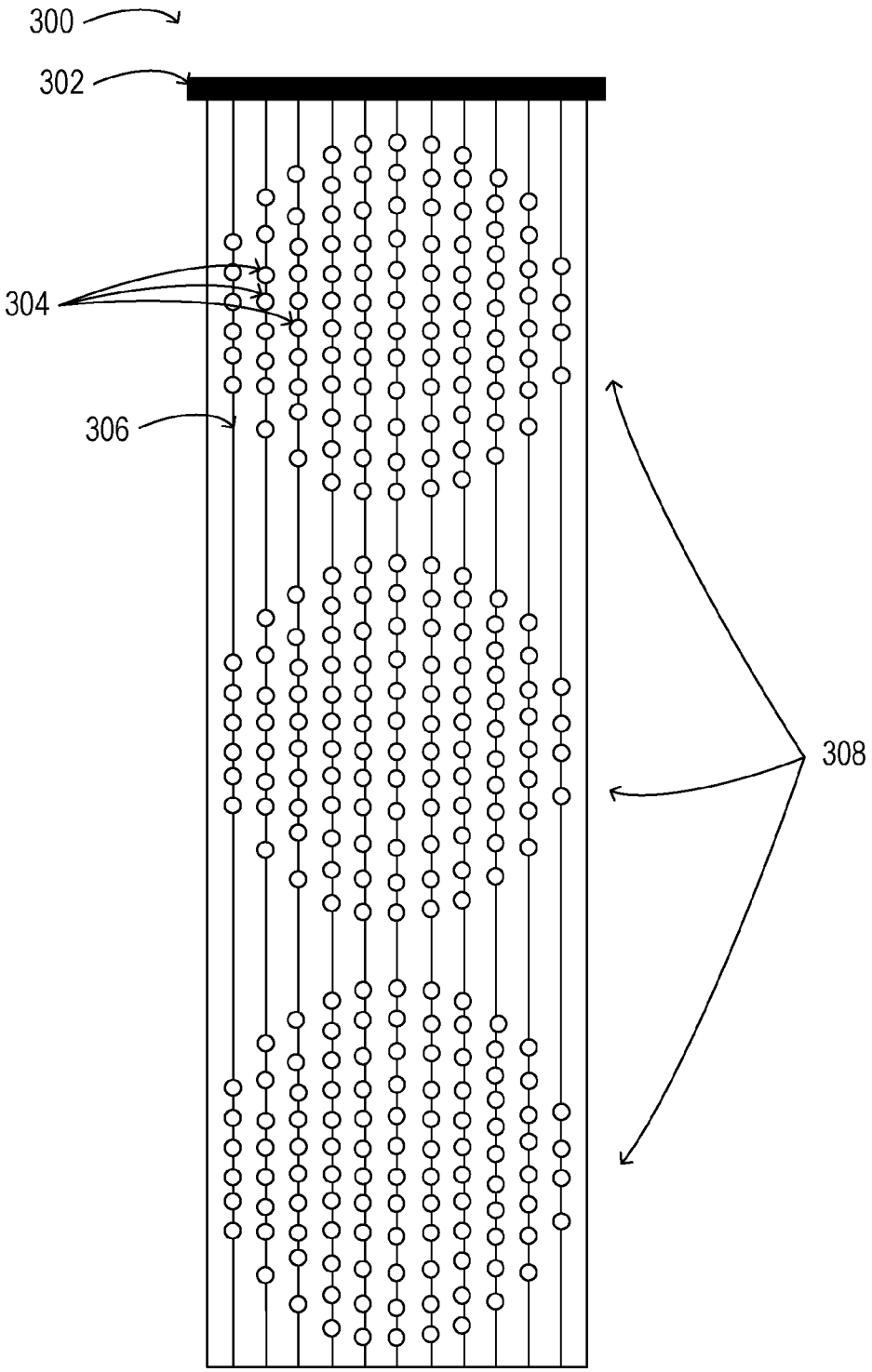
FIG. 6 is a schematic front view illustration of a low drag outdoor media façade display which may be used as a road sign, constructed and operative in accordance with an additional embodiment of the invention.

The façade display may further feature a frame for supporting the suspension elements, which may be divided into sub-frames. Reference is now made to FIG. 6, which is a schematic front view illustration of a low drag outdoor media façade display, generally referenced 300, constructed and operative in accordance with an additional embodiment of the invention. Façade 300 may be mounted on a horizontal beam or a vertical pole. Façade 300 includes a support frame 302, radiating elements 304, and suspension strips 306. Each of support frame 302, radiating elements 304, and suspension strips 306 are similar to support frame 108, radiating elements 125, and suspension strips 110, respectively, of FIG. 1. Façade 300 is designed to convey the same information as a traditional traffic control signal, which typically includes three lights (e.g., red, yellow, and green), each of which represents a different signal for approaching traffic (e.g., a signal to stop, a signal to proceed with caution, and a signal to proceed). There are three rounded clusters 308 of radiating elements 304 on façade 300. Façade 300 is designed to be lightweight with low drag features, as is consistent with the embodiments of the current invention. Because façade 300 is lightweight, the support structure of façade 300 may be much more simple, as compared to the support structure of a traditional traffic control signal, because façade 300 is much less bulky. While façade 300 is depicted with three roundish clusters 308 or radiating elements 304, this is not meant to be limiting and the actual shape or number of clusters of radiating elements may be shaped differently or more or less than three to fit the needs of the signal, as well as include any other road sign that may be permanently emitting light or incorporate a changing image seen on the screen or panel created by façade 300.

Figure 7:
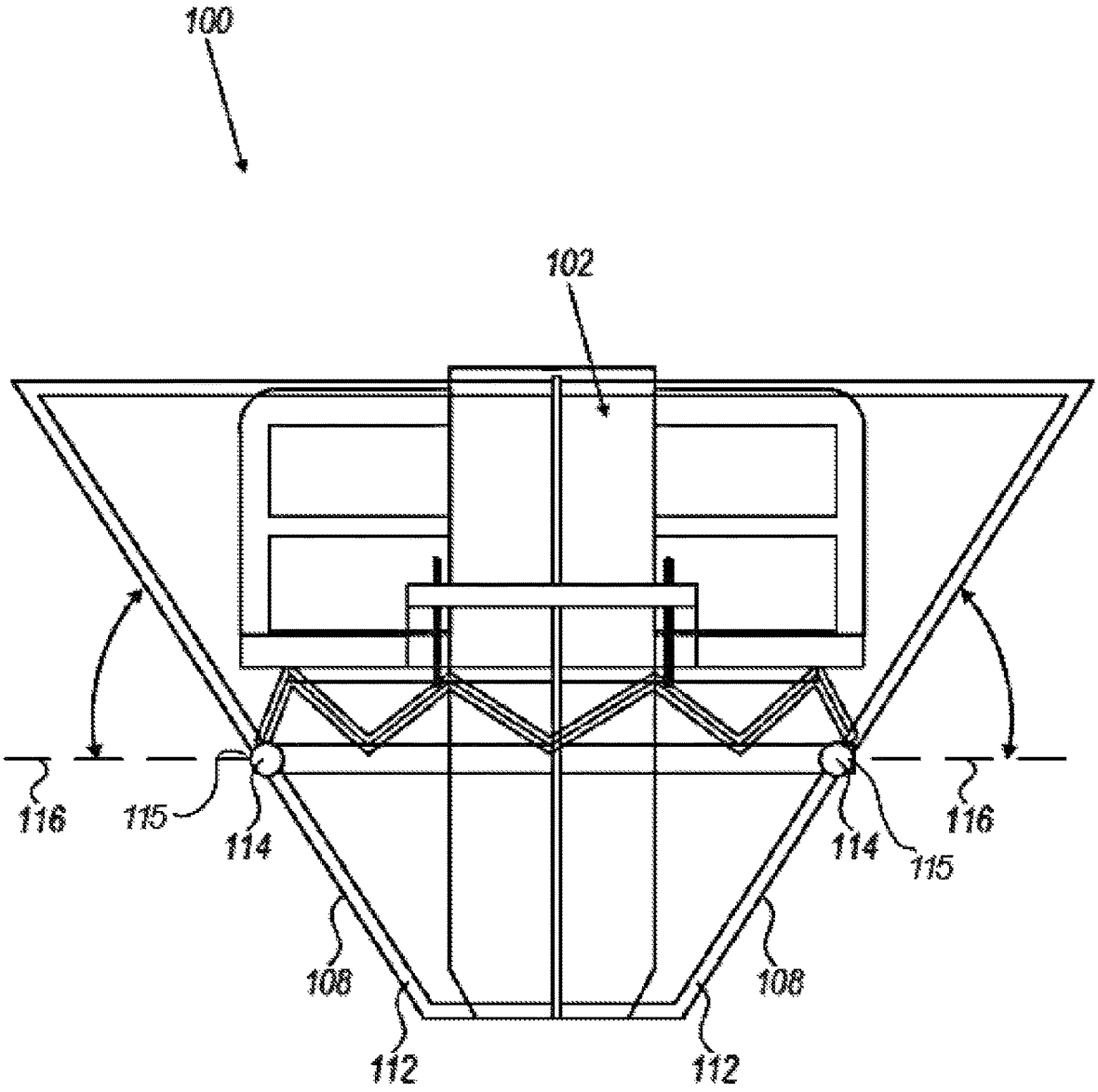
FIG. 7 is a side view illustration of the low drag outdoor media façade display of FIG. 1, in a deployed tilted configuration.
Figure 8:
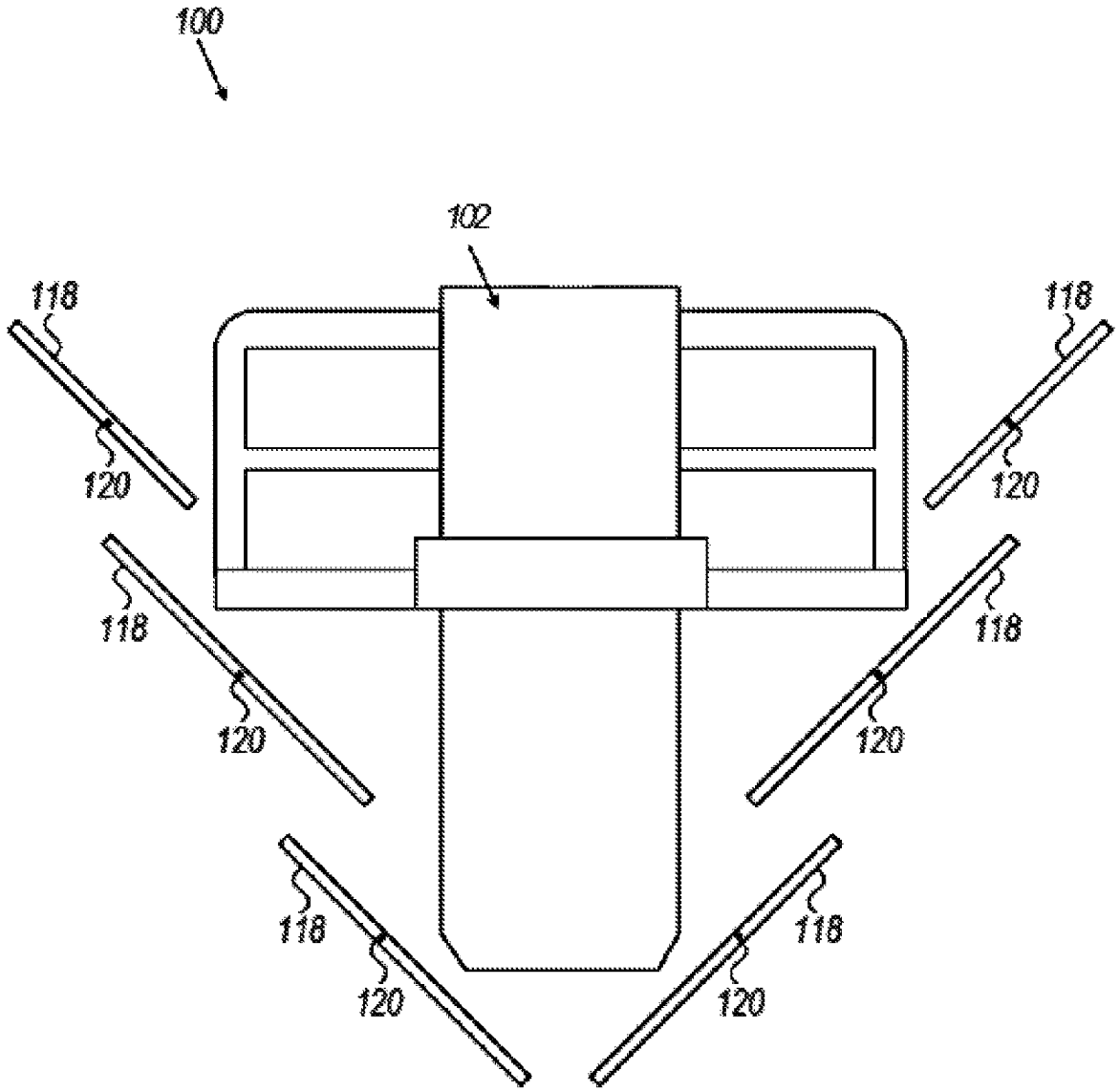
FIG. 8 is a side view illustration of the low drag outdoor media façade display of FIG. 1, in an independent partially collapsed configuration.
Figure 9:
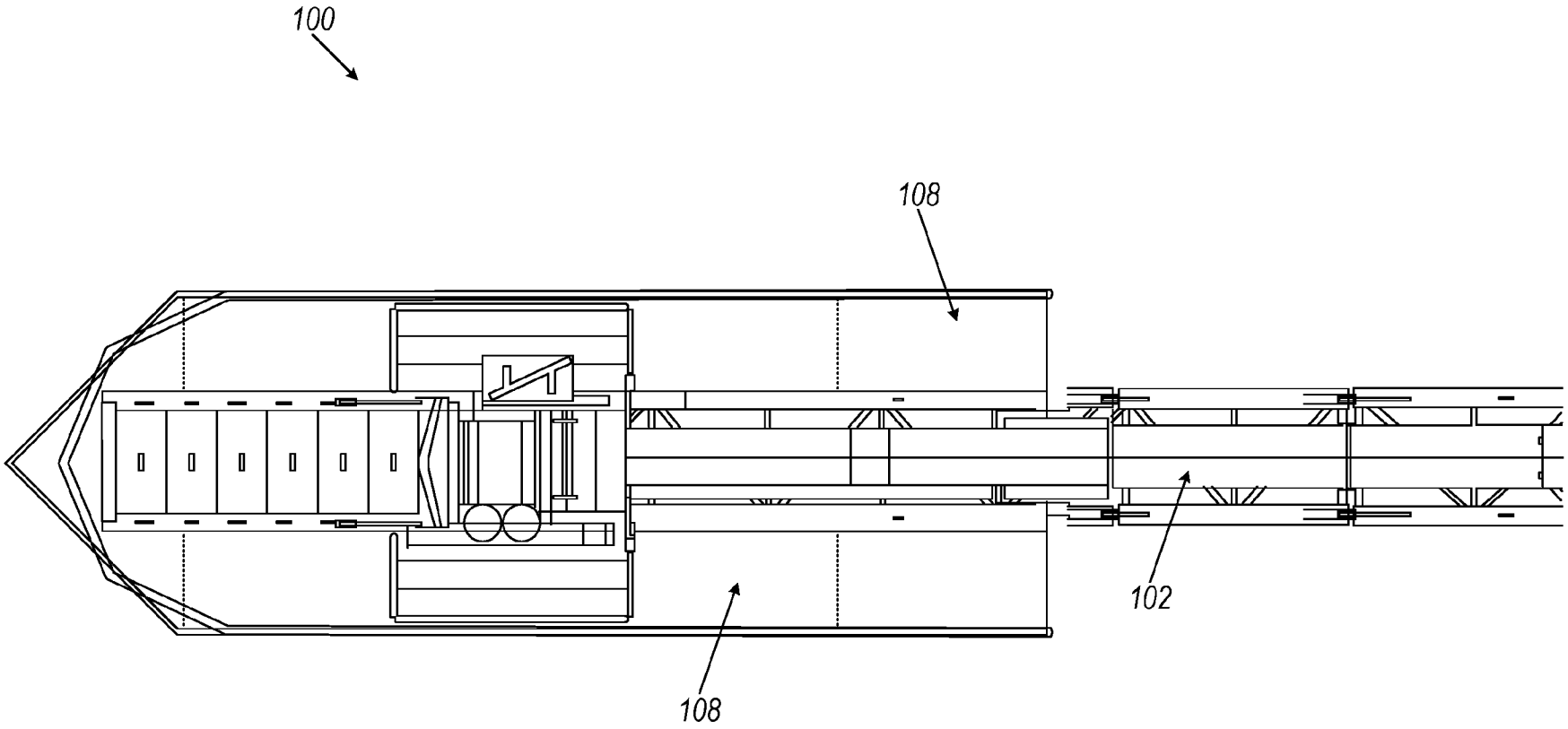
FIG. 9 is a top view illustration of the low drag outdoor media façade display of FIG. 1, in a deployed tilted configuration.

Reference is now made to FIGS. 7, 8 and 9. FIG. 7 is a side view illustration of the low drag outdoor media façade display 100 of FIG. 1, in a deployed tilted configuration. FIG. 8 is a rear-view illustration of the low drag outdoor media façade display 100 of FIG. 1, in a partially collapsed configuration. FIG. 9 is a top view illustration of the low drag outdoor media façade display 100 of FIG. 1, in a deployed tilted configuration. Hinge 114 pivots frame 108 and façade display 100 (by an active driving mechanism) into a temporary or permanent tilted position. The tilt of façade display 100 may be selectively chosen using an adequate tilting mechanism 115, having a tilt-activator or tilt-drive, such as one which tilts frame 108 at hinge 114 between a tilted 'display' position for display configuration and horizontal 'weather resistant' position denoted by perforated lines 116, configured to minimize drag in case of dangerously strong winds and stormy conditions. Façade display 100 may consist of sub-frames 118 and hinges 120. Sub-frames are sections of display façade 100. As shown, sub-frames 118 are horizontal but they may also be vertical (not shown). Hinges 120 pivotally secure sub-frames 118 against façade display 100 such that each sub-frame 118 is tilted separately at hinges 120 (by an active tilting mechanism) between a tilted display configuration and a horizontal storm-resistant configuration. The selective titling may also include, besides tilting into a totally horizontal, or upright, or extreme tilt, positions, intermediate positions configured to optimize the direction of the façade display to the target audience. Sub-frames 118 exemplify tilting portions of display 100, and these portions may be reduced to include each just a few suspension elements 110, as well as merely a single suspension element 110. Façade display includes maneuvering means for horizontal-vertical tilt thereof or in the desired sideways angle tilt, using a tilting frame or sub-frames, or by tilting each suspension element 110 or radiating element 125 on façade 100, for best exposure to the targeted audience.

Figure 10:
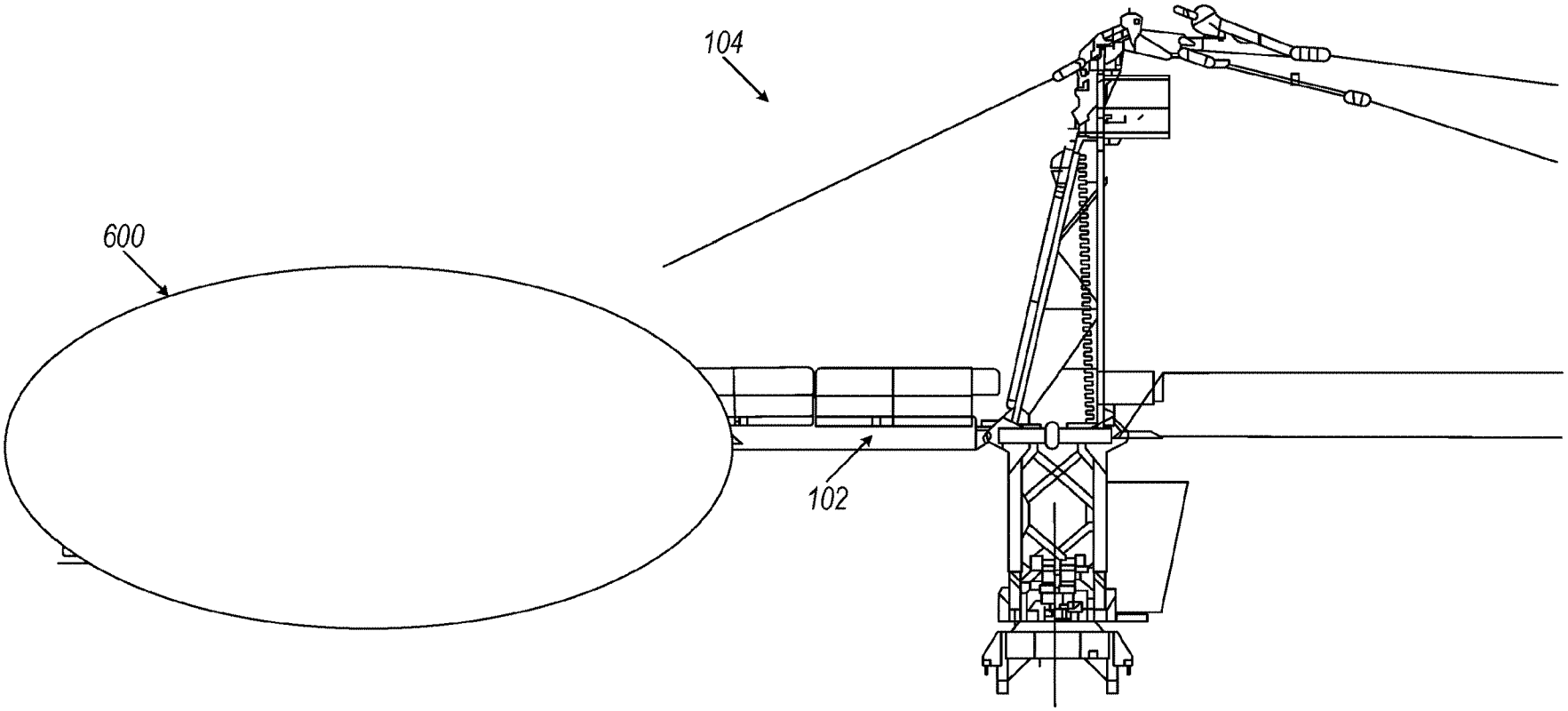
FIG. 10 is a schematic side view illustration of an ellipsoidal low drag outdoor media façade display constructed and operative in accordance with another embodiment of the invention, mounted on the working arm of a tower crane.

The embodiment of FIGS. 7-9 exemplifies a selective active tilting mechanism, with a controlled tilt-activation or tilt-drive, that allows selective orienting or titling of display 100 in its entirety, or of frame 108, or of sub-frames 118, or of suspension elements 110, or of radiating elements 125, for directing the façade or its radiating elements toward a desired display presentation direction, which may be also useful for controlling the reduction drag of the façade display according to the general wind conditions. Each such tilting mechanism can be used for, or replaced with, a passive, freely tilting mechanism, allowing free tilt one or more element, including free tilt of display 100 in its entirety, or of frame 108 (about hinge 114), or of sub-frames 118 (about respective hinges 120), or of suspension elements 110 (if elongated, about a respective axis there along), or of radiating elements 125 (usually about the respective suspension elements). As the two types of tilt (active selectively driven tilt, and passive free tilt) may interfere with each other at the same time, preferably each element may be either selectively, or freely, tiltable, whereas the same element is preferably not operational for both types of tilting at once, but may be tiltable by different tilt types, at different times Reference is now made to FIG. 10, which is a schematic side view illustration of an ellipsoidal low drag outdoor media façade display 600, constructed and operative in accordance with another embodiment of the invention, mounted on the working arm 102 of a tower crane 104. Façade display 600 features a spherical display surface, such as an ellipsoid, partially or fully enshrouding a portion of the holding structure, e.g., machinery arm 102 of tower crane 104. Façade display 600 may include a spherical or elliptical frame, over which suspension strips holds radiating elements, similar to those described in reference to FIG. 1. According to another alternative embodiment of the invention, the outdoor media façade display may feature an inflatable display screen, or a sail-like screen, that can be selectively collapsible, such as by its deflation or folding, at stormy conditions. The inflatable display screen may be spherical or elliptical.

Figure 11:
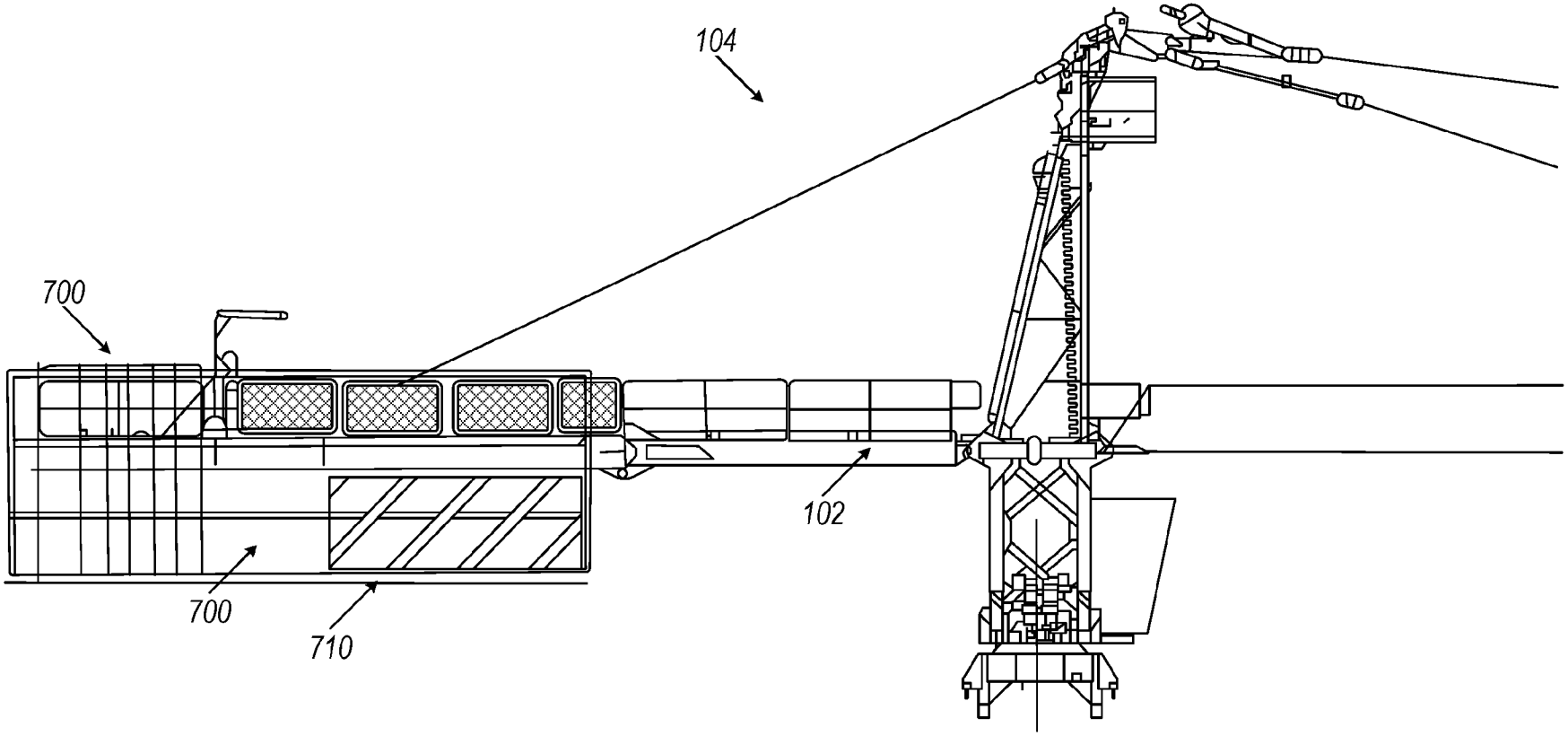
FIG. 11 is a schematic side view illustration of a low drag outdoor media façade display constructed and operative in accordance with an embodiment of the invention, featuring a liquid spray curtain mounted on an arm of a tower crane.

According to another alternative embodiment of the invention, outdoor media façade display may feature a liquid spray curtain. Reference is now made to FIG. 11, which is a schematic side view illustration of a low drag outdoor media façade display 700 constructed and operative in accordance with an embodiment of the invention. Façade display 700 features liquid spray curtain 706 mounted on working arm 102 of tower crane 104. Liquid spray curtain 706 may include a spray curtain such as is used for hydro shield projections, a water screen, or a fog screen. The sprayed liquid may feature droplets sprayed with jet nozzles, which spray downwards—from bottom to top, or upwards, from top to bottom. The sprayed liquid droplets are suitable for effectively refracting or reflecting light, particularly laser, projections thereon. Liquid spray curtain 706 may consist of very light water spray, that has been vaporized and is shaped by two very strong air shields, blowing along both sides of the curtain (usually the air is blown at the same direction the jet is sprayed). Liquid spray curtain 706 may be vertical—upright with liquid falling by the gravitational force, or have an angled/tilted or ballistic surface when sprayed at a direction having a horizontal component, or when shaped with the force of frontal and/or rear air shield(s). The sprayed liquid can be collected for reuse by means of narrow trough 710 extending along the bottom rim of façade display 706.

Media façade display 700 is virtually drag free, as liquid spray curtain 706, by virtue of its surface area being formed of a liquid spray which is not a rigid formation mounted to any structure (i.e., to arm 102 or crane 104), and as liquid spray would disperse by strong winds. When wind blows at intensity to the extent the spray is dispersed, reflection or refraction may be temporarily tampered, for the sake of providing a façade display that poses no barrier to wind that might jeopardize the stability of crane 104. The side air shields are effective to reduce the dispersion of spray due to the strong wind, as such wind is deflected by the side air shields, without relaying substantial wind force to the display or the support structure, because the air shields are not a rigid object which is rigidly secured to any other parts. The spaying may also be actively discontinued until the passing of overly windy conditions, to save loss of liquid dispersed and a costly operation of an ineffective display, but as the curtain bears little relevance to drag, such spray discontinuation would not be called for reducing drag.

While certain embodiments of the disclosed subject matter have been described, so as to enable one of skill in the art to practice the present invention, the preceding description is intended to be exemplary only. It should not be used to limit the scope of the disclosed subject matter, which should be determined by reference to the following claims.

The invention claimed is:

1. A low drag outdoor media façade display for mounting on a structure susceptible to instability and tumbledown of said structure when subjected to strong winds and gusts blowing on said façade surface area, said façade display comprising an array of radiating elements and an array of suspension elements, wherein said array of radiating elements is dispersed about said façade display, said radiating elements are held by said suspension elements, said suspension elements are supported by a frame of said façade display, or by sub-frames of said frame, said radiating elements and said suspension elements are spaced apart leaving gaps, such that said total surface area of said radiating elements, and said suspension elements is smaller than the total area of said façade display, minimizing drag on said façade display;

wherein each of said radiating elements is aerodynamically shaped and configured to rest in a particular positioning in still air and to freely rotate about an axis running therethrough with respect to said façade frame, or the respective sub-frame, on which each of said radiating elements is held when subjected to an incident wind, so as to increase free air passage through the façade display and thereby reduce the drag coefficient of the façade display.

2. The low drag outdoor media façade display of claim 1, wherein said structure comprises at least one selected from the list consisting of: a high rise lightweight structure; a lattice mast; a tower; an arm; a boom; a machine arm of a tower crane; a crane; a hammerhead crane; a tower crane; a gantry; a derrick; scaffoldings; a fence; permanent or temporary structure; a lattice structure; a mobile structure; a pillar; a mast; a land vehicle, a marine vehicle, and an aerial vehicle hauling a towed banner.

3. The low drag outdoor media façade display of claim 1, comprising a display selected from the list consisting of: a hoarding, a bulletin, a poster, a marquee, a banner, a placard, a billing board, a billboard, a mobile billboard, a digital billboard, a mechanical billboard, a three-dimensional billboard, a street sign, and a traffic control signal.

4. The low drag outdoor media façade display of claim 1, wherein said radiating elements comprise at least one selected from the list consisting of: reflecting elements; refracting elements; emitting elements; optical reflectors; mirrors; optical refractors; lenses, liquid lenses; light emitting sources; and led elements.

5. The low drag outdoor media façade display of claim 1, wherein each of said radiating elements comprises a tail configured to be pushed backward by the wind and cause said radiating element to rotate for increasing the free air passage through the façade display and thereby reduce the drag coefficient of the façade display; and to block rear light from interfering with a view of said façade display from a primary viewing angle when the wind is below a threshold that effects rotation of said radiating elements.

6. The low drag outdoor media façade display of claim 1, wherein at least one of: said façade display, a frame supporting said suspension elements, and sub-frames of said frame is mounted with its display plane angled towards the horizon with respect to a vertically upright position.

7. The low drag outdoor media façade display of claim 1, wherein at least one of: said façade display, a frame supporting said suspension elements, and sub-frames of said frame, is passively tiltable in response to wind blowing on said façade surface area.

8. The low drag outdoor media façade display of claim 1, further comprising an active tilting mechanism for enhancing exposure to targeted audience, by diverting the display orientation in a horizontal-vertical tilt and/or in a sideways-angle tilt of at least one of: a frame supporting said suspension elements; sub-frames of said frame; each suspension element on which said radiating elements are mounted onto; and each radiating element.

9. A flock of the outdoor media façade displays of claim 8 wherein each display is respectively mounted on a distinct structure of a multiplicity of spaced apart structures crowded in an area viewable by an audience, wherein the flock of façade displays is synchronized to maneuver to directions suitable for reaching said audience and for creating a mega-display presentation combined by the scenery resulting by all of the participating façade displays.

10. The low drag outdoor media façade display of claim 1, further comprising at least one of:

an inflatable display screen;

a collapsible display screen;

a spherical display surface; and an ellipsoidal display surface, wherein said display partially or fully enshrouds a portion of said structure.

11. A low drag outdoor media façade display for mounting on a structure susceptible to instability and tumbledown of said structure when subjected to strong winds and gusts blowing on said façade surface area, said façade display comprising an array of radiating elements, an array of suspension elements, and an active tilting mechanism, wherein said array of radiating elements is dispersed about said façade display, said radiating elements are held by said suspension elements, said radiating elements and said suspension elements are spaced apart leaving gaps, such that said total surface area of said radiating elements, and said suspension elements is smaller than the total area of said façade display, minimizing the drag of said façade display, and wherein said active tilting mechanism selectively tilts, with respect to an upright position, in correlation with wind conditions, at least one of: said façade display, a frame supporting said suspension elements; sub-frames of said frame; said suspension elements; and said radiating elements, said active tilting mechanism comprising a tilt-activator operative to activate the active tilting mechanism in response to and in correlation with the intensity of wind blowing on the façade display, to thereby alter the overall cross-section area facing the wind for altering a wind load drag profile of said façade display to accommodate said intensity of wind.

12. The low drag outdoor media façade display of claim 11, wherein at least one of: said façade display, said frame, sub-frames of said frame; said array of suspension elements, and said array of radiating elements, is passively tiltable in response to wind blowing on said façade surface area.

13. The low drag outdoor media façade display of claim 11, wherein said frame supporting said suspension elements encloses said façade display at its peripheral rim, and wherein said suspension elements comprise suspension strips arranged according to at least one of: horizontal; vertical; and mesh configuration.

14. The low drag outdoor media façade display of claim 11, wherein said active tilting mechanism selectively tilts one of said frame, said sub-frames, said suspension elements, and said radiating elements into position selected from the list consisting of: a horizontal position; an upright position; a collapsible configuration; a position configured to direct said radiating elements towards a desired direction, and a position configured to minimize drag.

15. The low drag outdoor media façade display of claim 11, wherein said structure comprises at least one selected from the list consisting of: a high rise lightweight structure; a lattice mast; a tower; an arm; a boom; a machine arm of a tower crane; a crane; a hammerhead crane; a tower crane; a gantry; a derrick; scaffoldings; a fence; permanent or temporary structure; a lattice structure; a mobile structure; a pillar; a mast; a land vehicle, a marine vehicle, and an aerial vehicle hauling a towed banner.

16. The low drag outdoor media façade display of claim 11, comprising a display selected from the list consisting of: a hoarding, a bulletin, a poster, a marquee, a banner, a placard, a billing board, a billboard, a mobile billboard, a digital billboard, a mechanical billboard, a three-dimensional billboard, a street sign, and a traffic control signal.

17. The low drag outdoor media façade display of claim 11, wherein said radiating elements comprise at least one selected from the list consisting of: reflecting elements; refracting elements; emitting elements; optical reflectors; mirrors; optical refractors; lenses, liquid lenses; light emitting sources; and led elements.

18. The low drag outdoor media façade display of claim 11, further comprising at least one of:

an inflatable display screen;

a collapsible display screen;

a spherical display surface; and an ellipsoidal display surface, wherein said display partially or fully enshrouds a portion of said structure.

19. The low drag outdoor media façade display of claim 11, wherein the active tilting mechanism enhances exposure to a targeted audience, by diverting said display in at least one of: a horizontal-vertical tilt and a desired sideways angle tilt, by tilting at least one of: said frame; sub-frames of said frame; each suspension element on which said radiating elements are mounted onto; and each radiating element.

20. A flock of the outdoor media façade displays of claim 19, wherein each display is respectively mounted on a distinct structure of a multiplicity of spaced apart structures crowded in an area viewable by an audience, wherein the flock of façade displays is synchronized to maneuver to directions suitable for reaching said audience and for creating a mega-display presentation combined by the scenery resulting by all of the participating façade displays.

* * * * *